US005120176A

United States Patent [19]

Bhatia et al.

[11] Patent Number: 5,120,176

[45] Date of Patent: Jun. 9, 1992

[54] FABRICATION OF BOUND DOCUMENTS

[75] Inventors: Sushil K. Bhatia; David J. Leahy, both of Framingham; Herman Abber, Brockton; Laurence E. Tighe, Milford, all of Mass.

[73] Assignee: Dennison Manufacturing Company, Framingham, Mass.

[21] Appl. No.: 737,095

[22] Filed: Jul. 29, 1991

[51] Int. Cl.[5] ..... B42C 9/00; B42B 7/04; B42D 1/00

[52] U.S. Cl. ..... 412/8; 412/17; 412/900; 281/21.1; 281/28

[58] Field of Search ..... 412/8, 17, 36, 900, 412/16; 281/21.1, 28

[56] References Cited

U.S. PATENT DOCUMENTS

| | | | |
|---|---|---|---|
| 4,367,061 | 1/1983 | Wiholm | 412/17 X |
| 4,471,976 | 9/1984 | Giulie | 412/8 X |
| 4,855,573 | 8/1989 | Vercillo et al. | 412/900 X |
| 4,863,332 | 9/1989 | Wiholm | 412/8 X |
| 5,035,561 | 7/1991 | Loibl | 412/900 X |
| 5,066,183 | 11/1991 | Tholirus | 412/900 X |

*Primary Examiner*—Paul A. Bell
*Attorney, Agent, or Firm*—Irving M. Kriegsman; Arthur B. Moore

[57] ABSTRACT

A bound document is made by placing one or more sheets of paper to be bound inside a binder having a hot-melt adhesive and then exposing the binder to microwave energy for a sufficient period of time to cause the hot-melt adhesive to melt bond onto an edge of the sheets of paper. In one embodiment of the invention, the hot-melt adhesive is microwave activatable. In another embodiment of the invention, the hot-melt adhesive is not necessarily microwave activatable and the binder includes a strip of susceptor material which converts incident microwave radiation to heat. In still another embodiment of the invention, the hot-melt adhesive is not necessarily microwave activatable and a quantity of microwave responsive material is incorporated into the hot-melt adhesive. In still yet another embodiment, the hot-melt adhesive is not necessarily microwave activatable, and a microwave susceptor is incorporated into a stand on which the binder may be placed during exposure to the microwave radiation.

24 Claims, 9 Drawing Sheets

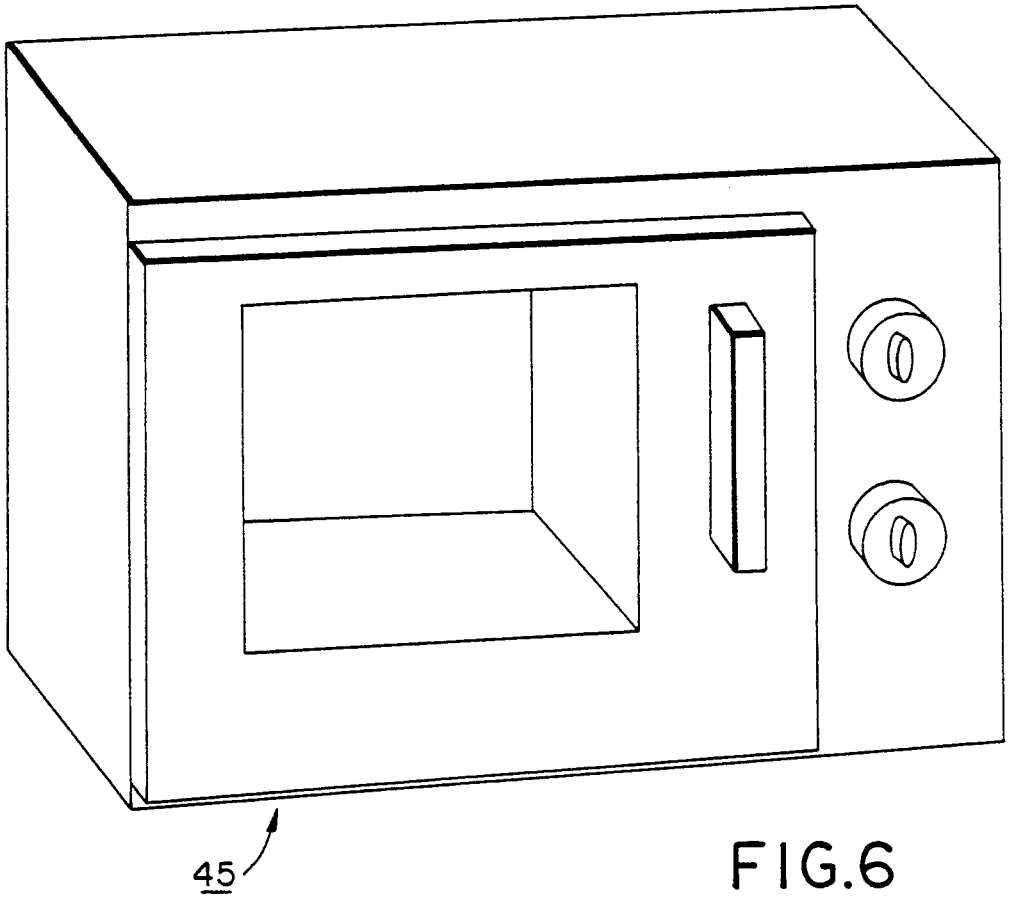
FIG.6
FIG.7
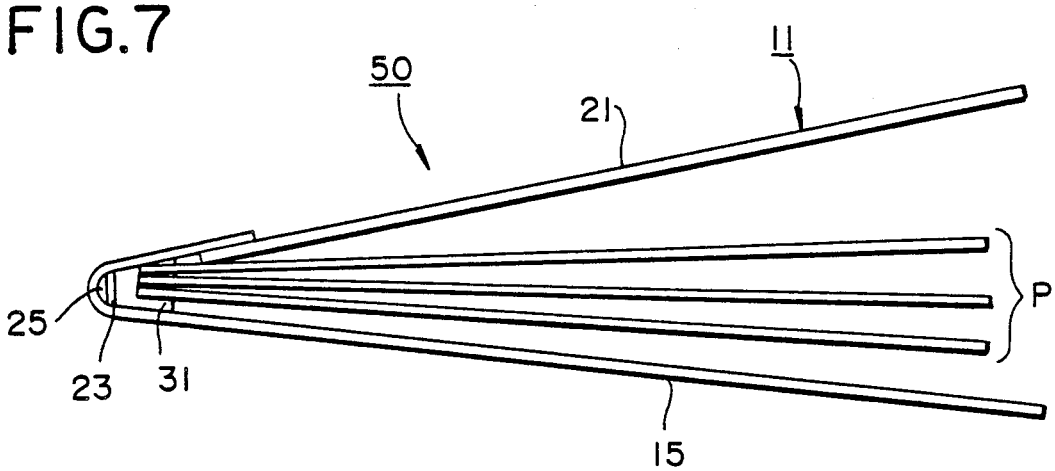

FABRICATION OF BOUND DOCUMENTS

The present invention relates generally to the fabrication of bound documents and more particularly to the fabrication of bound documents using a binder having a hot-melt adhesive.

A variety of different techniques are known for binding together sheets of paper so as to produce a bound document. At one end of the spectrum are paper clips, staples, and the like. Such devices are inexpensive and easy to use but often fail to securely and permanently bind together the sheets of paper and often result in a bound document that is not aesthetically pleasing. Towards the middle of the spectrum are ring binders, spiral binders, and various types of fastener type binders. These binders are relatively easy to use and result in a more cosmetically attractive product but are more expensive than clips or staples, usually require the time-consuming task of having to punch holes in each sheet of paper being bound, and often result in a product that cannot be stacked easily. Finally, at the other end of the spectrum are adhesive binders. An adhesive binder typically includes a blank of cardboard and/or plastic which is cut and scored to define a front cover, a back cover, a spine and a quantity of adhesive material. The adhesive material is adhered to the spine and is used to bond the sheets of paper to be bound to the spine. One type of adhesive that is used in this type of binder is a thermoplastic (i.e. hot-melt) adhesive This type of adhesive typically exists in a solid state at room temperature. A method and apparatus for making a binder using a thermoplastic adhesive is described in U.S. Pat. Nos. 4,606,669 and 4,367,061.

Adhesive binders having a hot-melt type of adhesive result in a bound document which is aesthetically appealing, easy to stack and does not require holes to be punched in the sheets of paper being bound. However, the disadvantage with such binders is that they require a special binding machine to melt bond the adhesive material onto the edges of the sheets of paper. As can readily be appreciated, most people do not own such a binding machine (which is typically quite expensive) and therefore must go to a store where such a machine can be found. Clearly, this can be quite an inconvenience as well as being expensive.

Accordingly, it is an object of the present invention to provide a new and improved technique for making a bound document.

It is another object of the present invention to provide a technique as described above which does not require the use of a specifically-designed binding machine.

It is still another object of the present invention to provide a technique as described above which does not require the punching of holes in the sheets of paper being bound.

It is still yet another object of the present invention to provide a technique as described above which can be practiced simply and quickly.

It is a further object of the present invention to provide a technique as described above which results in an aesthetically appealing product that can be stacked easily.

SUMMARY OF THE INVENTION

In accordance with the objects broadly recited herein, the present invention is generally directed to the fabrication of a bound document wherein microwave energy is used to melt the adhesive in a hot-melt adhesive binder. To reduce the period of time required to melt the hot-melt adhesive and/or to permit the use of hot-melt adhesives which otherwise would not melt as quickly as desired (and in any event, before the paper or binder becomes damaged), the present invention further envisions using a microwave susceptor to convert some of the microwave energy into heat, which is concentrated at the hot-melt adhesive.

In one arrangement, a microwave susceptor is sandwiched between the hot-melt adhesive and the spine of the binder. In another arrangement, microwave absorptive materials are incorporated directly into the hot-melt adhesive. In a third arrangement, a microwave susceptor is incorporated into a stand upon which the binder may be placed while it is being exposed to the microwave energy.

Another aspect of the invention relates to method and apparatus for supporting the binder within a conventional microwave oven, to permit the melting of the hot melt adhesive, and the even, secure engagement of the sheet edges to be encapsulated by the activated adhesive. In the binding method of the invention, the binder containing sheets to be bound is supported within the microwave oven at a 30° to 90° angle with respect to the oven floor, with the spine lowermost. Preferably, the spine is supported somewhat above the floor of the oven, at a region of relatively high intensity of the microwave energy. This method may be effected by housing the binder in an appropriately configured stand. Alternatively, the binding apparatus may comprise a microwave device which is specially designed for this application.

A further aspect of the invention is the choice of hot melt adhesive. It is preferred to employ an adhesive with a melting temperature between 180° F. - 350° F. (82° C. - 177° C.), most preferably between 250° F. - 350° F (121° C. 177° C.). Advantageously, the adhesive has a melt viscosity which is low enough to permit the sheet edges to sink into the molten adhesive under the force of gravity, yet is not so low that the adhesive will flow from the binder spine.

As noted above, the present technique uses microwave radiation. Such radiation may be provided by a conventional microwave oven. Given that more than 75% of U.S. households already own a microwave oven, the present technique promises to be more convenient than alternative hot-melt adhesive binding techniques, which require the use of special binding machines.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In these drawings wherein like reference numerals represent like parts:

FIG. 6 is a perspective view of a conventional microwave oven omitting any metal microwave screen in the door window;

FIG. 7 is an end view of a bound document fabricated using the binder shown in FIG. 1;

DETAILED DESCRIPTION

As discussed above, one facet of the present invention is the use of microwave energy to melt a hot-melt adhesive which has been affixed to a document binder so that the adhesive will adhere onto the edge of one or more sheets of paper to be bound and thereby produce a bound document. Although hot-melt adhesives that are microwave-activatable are known in the prior art —typically, having polar functional groups and low melting temperatures—applicants have observed that it is highly desirable to employ a microwave susceptor structure or material to convert more of the microwave energy into heat at the adhesive. This permits the binding to be effected without overdrying or overheating the paper or binder. As will be discussed below in greater detail, the susceptor may be incorporated into the binder in a variety of ways; may comprise a separate layer under the adhesive layer; may comprise an additive material for the adhesive itself; or may be incorporated into a stand onto which the binder would be placed while being exposed to the microwave energy.

Figure 1:
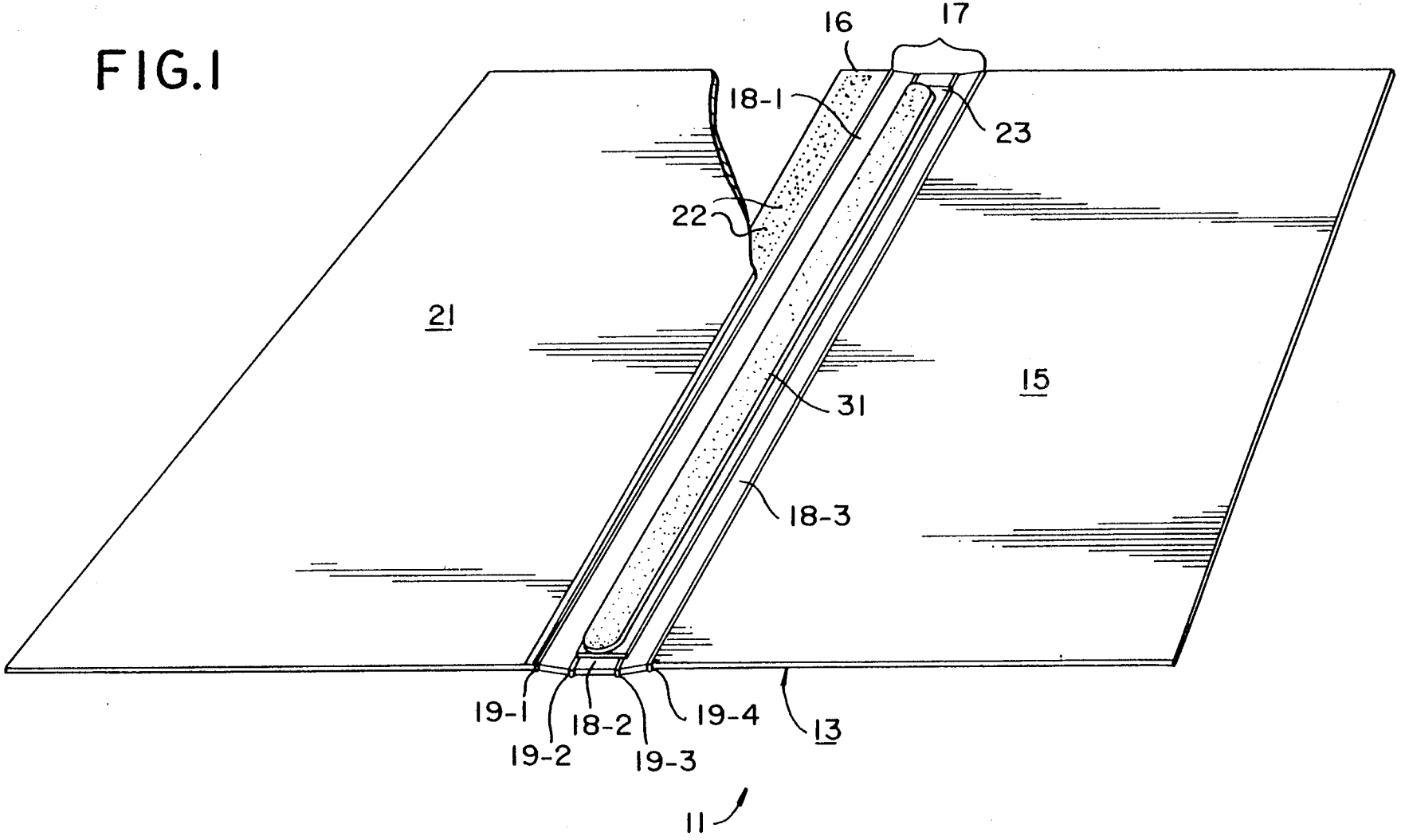
FIG. 1 is a perspective view, broken away in part, of one embodiment of a binder constructed according to the teachings of the present invention, the binder being shown from the inside in a folded-out, flat condition.
Figure 2:
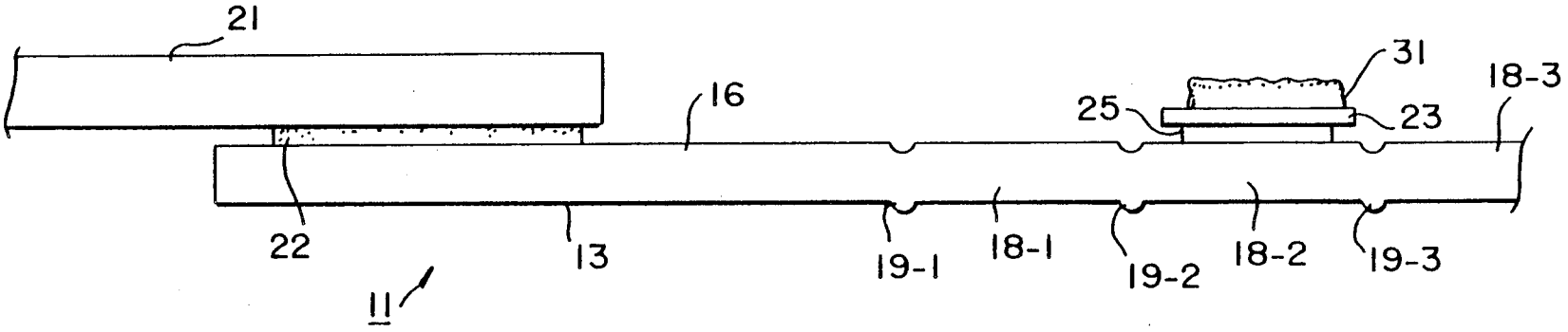
FIG. 2 is an enlarged fragmentary end view of the binder shown in FIG. 1.

Referring now to the drawings and more particularly to FIGS. 1 and 2, there is illustrated one embodiment of a binder constructed according to the teachings of the present invention, the binder being represented generally by reference numeral 11.

Binder 11 comprises a blank 13 made of a sheet of cardboard, paperboard, plastic, or other suitable material, which is of suitable thickness and which is cut and scored to define a rectangular back cover 15, a glue flap 16, and a spine 17. Spine 17, which is located between cover 15 and glue flap 16, includes three panels 18-1, 18-2, and 18-3, which are separated by four crease lines 19-1 through 19-4, respectively. The width of panel 18-2 is preferably sized according to the number of sheets of paper that are to be bound together. For example, if the binder is used to make a bound document having approximately 1–25 sheets of paper, panel 18-2 is preferably about one-eighth of an inch wide.

Binder 11 also comprises a front cover 21 made of polyvinyl chloride, polypropylene, acetate, or other similar material that is transparent to visible light so as to permit the contents of binder 11 to be seen therethrough. Front cover 21 is affixed to the inside of glue flap 16 with an adhesive 22.

As can readily be appreciated, the above-described combination of blank 13 and front cover 21 for use in making a binder is merely exemplary. An alternative construction might include a unitary blank made of cardboard, paperboard, plastic, or other suitable material, which is cut and shaped to define a front cover, a spine, and a back cover. In fact, the front and back covers may be omitted altogether, provided that suitable means are provided to support the sheets during bonding. Additional constructions undoubtedly exist and will be apparent to one of ordinary skill in the art.

Binder 11 further comprises a strip of microwave susceptor material 23. Susceptor 23 may be comprised of any type of microwave susceptor material but is preferably a bi-layer film comprising a thin conductive layer, which is used to convert incident microwave energy into heat, and a heating surface layer, which is placed in contact with the object to be heated. An example of such a susceptor is a polyester film metallized with vacuum deposited aluminum and, in particular, is a 45 gauge (0.00045"or 11 microns) polyester film metallized with vacuum deposited aluminum to an optical density of about 0.18–0.29, illustratively one made by UltraVac Metallizing, Bloomfield, Conn. Alternative suppliers of microwave susceptors include Deposition Technology, San Diego, Calif., and Scharr Industries, Bloomfield, Conn. Other examples include a polyester film or other high temperature film having a thin layer of sputter coated stainless steel, a high temperature film having a thin layer of brass and/or copper, and a high temperature film having a thin layer of carbon black loaded coating.

The conductive layer of susceptor 23 is affixed to the inside of panel 18-2 using an adhesive 25 (see FIG. 2), which is preferably about 0.2 mils thick. Adhesive 25 is preferably made of a substance which will not melt when binder 11 is exposed to microwave energy. The carrier surface of susceptor 23 faces upwardly and is placed in contact with the hot-melt adhesive to be described below. The width of susceptor 23 is approximately equal to that of panel 18-2, and the length of susceptor 23 is approximately one inch (2.5 cm) shorter than that of panel 18-2. Preferably, susceptor 23 is centered along the length of panel 18-2 so as to leave about a ½ inch (1.3 cm) space at the top and bottom thereof.

Binder 11 further comprises a layer of hot-melt adhesive 31, which is preferably about 20–35 mils (0.5–0.9 mm) thick. Adhesive 31 is extruded onto the carrier surface of susceptor 23, either before or after susceptor 23 has been affixed to spine 17, and is then bonded thereto with a combination of elevated temperature and pressure. Preferably, the dimensions of adhesive 31 and susceptor 23 are the same.

Adhesive 31 must be sufficiently heat-sensitive so that, when coupled to susceptor 23, it will melt before susceptor 23 loses conductivity and/or before the sheets of paper being bound become damaged by microwave radiation (which typically occurs in about 2–3 minutes of exposure to 600–700 watts of microwave energy). Therefore, a low melting point hot-melt adhesive is preferred. Most hot-melt adhesives, when coupled to susceptor 23 in the manner described herein, will melt within the above time constraints and typically in less than about 1–1.5 minutes of exposure to 600–700 watts of microwave energy. In fact, as will be discussed below in greater detail, certain hot-melt adhesives have been found to melt within about 30–45 seconds of exposure to 600–700 watts of microwave energy. Adhesive 31 should have an appropriate melt viscosity so that, when the adhesive is molten, the sheets of paper will sink into the adhesive, but the adhesive will not drip out of the binder. Preferably, adhesive 31 is F.D.A. approved for indirect food contact.

Examples of hot-melt adhesives 31 include adhesives having an ethylene methyl acrylate base and a hydrogenated terpene tackifier resin. In particular, the base resin may be an ethylene/methyl acrylate copolymer. Such adhesives may be light stabilized with 0.5% Tinuvin 326 or 327 (made by Ciba Geigy) and may also include 0.5% Irganox 1010 antioxidant and/or 0.5–1% Acrowax C (made by Glyco Corp.) as an anti-blocking agent.

Additional examples of hot-melt adhesives 31 include polyamide adhesives, polyester adhesives, acrylic adhesives, ethylene acrylate adhesives, and ethylene vinyl acetate adhesives.

In an embodiment of the invention that was actually built and tested, a polyester film having a thin layer of vacuum deposited aluminum with an optical density between 0.18–0.29 was employed as susceptor 23 and an 80% ethylene/20% methyl acrylate copolymer base resin with a water white, fully hydrogenated synthetic terpene tackifier resin was employed as hot-melt adhesive 31. This combination resulted in sufficient melting of the adhesive to be used to produce a bound document after about 30 seconds of exposure to 600–700 watts of microwave radiation.

In another embodiment of the invention that was actually built and tested, a polyester film having a thin layer of vacuum deposited aluminum with an optical density between 0.18–0.29 was employed as susceptor 23 and an ethylene vinyl acetate adhesive composition having a high ethylene content and a low vinyl acetate content was employed as hot-melt adhesive 31. This combination resulted in sufficient melting of the adhesive to be used to produce a bound document after about 45 seconds of exposure to 600–700 watts of microwave energy.

Figure 4:
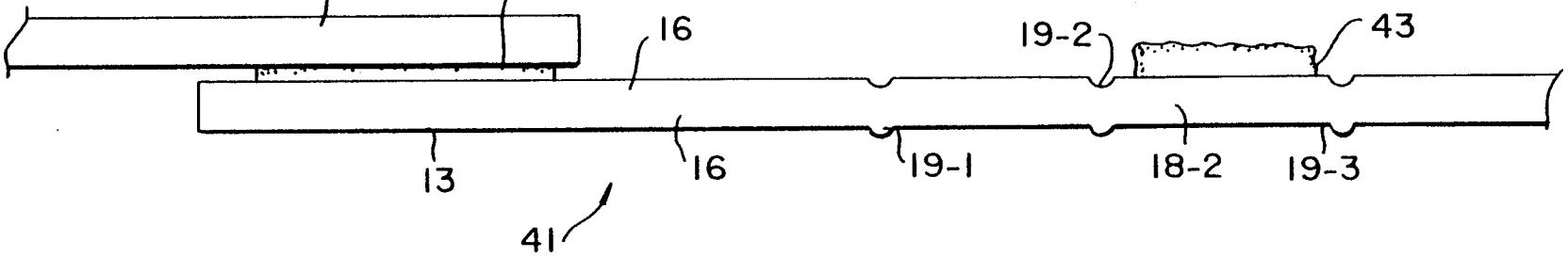
FIG. 4 is an enlarged fragmentary end view of the binder shown in FIG. 3.
Figure 3:
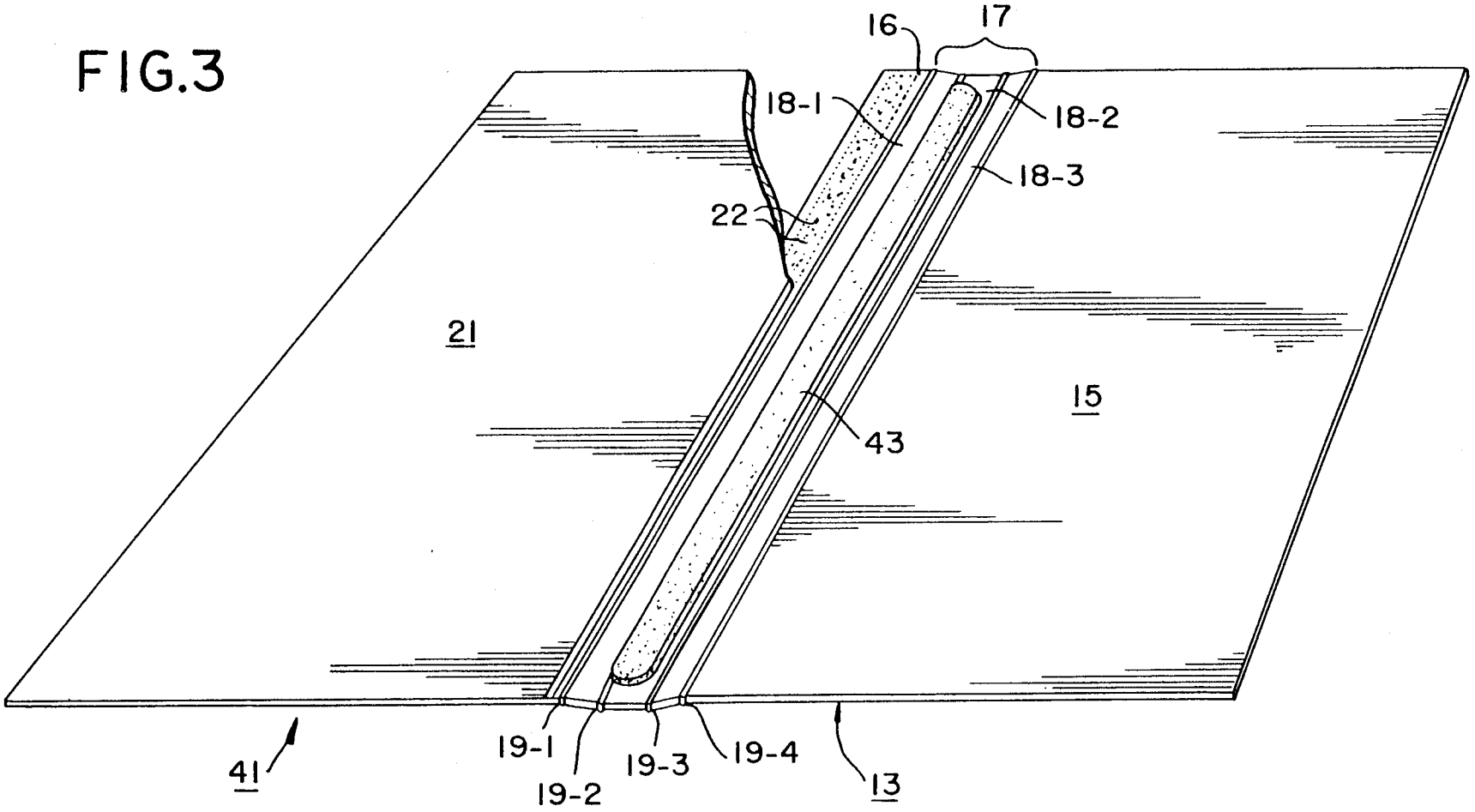
FIG. 3 is a perspective view, broken away in part, of a second embodiment of a binder constructed according to the teachings of the present invention, the binder being shown from the inside in a folded-out, flat condition.

Referring now to FIGS. 3 and 4, there is illustrated another embodiment of a binder for making a bound document according to the teachings of the present invention, the binder being represented generally by reference numeral 41.

Binder 41 is similar in construction to binder 11, the only differences being that susceptor 23 and adhesive 31 of binder 11 are replaced in binder 41 with a single layer of adhesive material 43 and that adhesive 25 of binder 11 is not present in binder 41 since material 43 is self-adhering to spine 17. In the embodiment of FIGS. 3 and 4, the microwave susceptor is not a separate structure such as in FIGS. 1 and 2, but rather is an additive to the hot-melt adhesive 43.

An example of the type of composition to be used as material 43 is disclosed in U.S. Pat. No. 4,906,497 to Hellmann et al., herein incorporated by reference. The '497 patent describes a hot-melt adhesive comprising at least one component which under the action of microwaves on the dry hot-melt adhesive leads to an increased heating-up rate compared with a corresponding hot-melt adhesive without said component, said component containing microwave responsive substances. Suitable substances include carbon fibers, carbon black, graphite, antistatic agents, and metal particles, either on their own or in mixtures adapted to the use.

Figure 5:
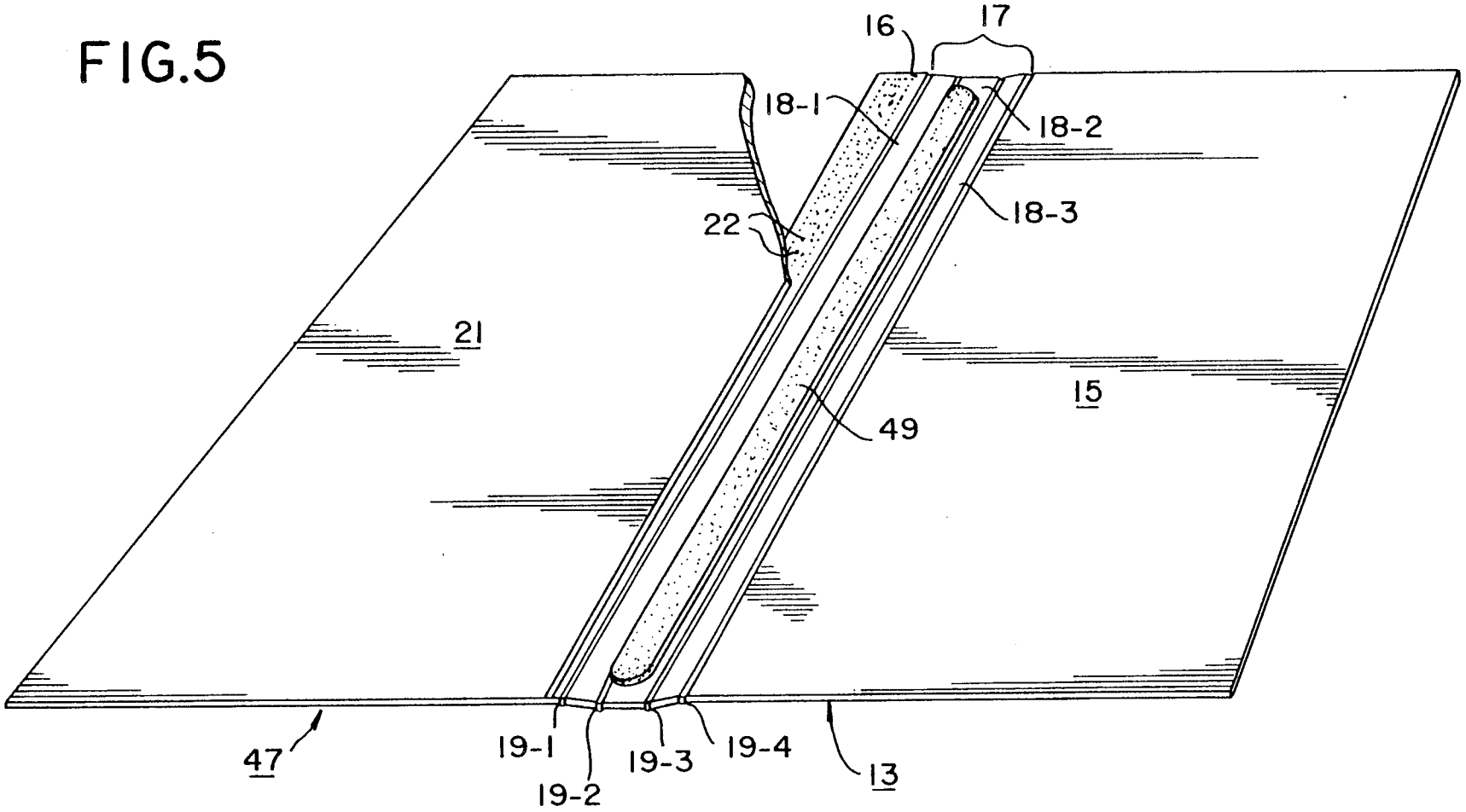
FIG. 5 is a perspective view, broken away in part, of a third embodiment of binder constructed according to the teachings of the present invention, the binder being shown from the inside in a folded-out, flat condition.

Referring now to FIG. 5, there is shown another embodiment of a binder for making a bound document in accordance with the method of the present invention, the binder being represented generally by reference numeral 47.

Binder 47 is similar in construction to binder 41 (FIG. 3), the only difference between the two binders being that adhesive material 43 of binder 41 is replaced with a hot-melt adhesive 49 in binder 47. Adhesive 49 does not include a susceptor component but is sufficiently microwave-activatable that it will melt from exposure to microwave radiation in an appropriately short period of time. Examples of suitable materials for adhesive 49 are discussed above.

To make a bound document using a hot-melt adhesive binder in accordance with the present invention, the sheets of papers to be bound are aligned relative to each other and their longitudinal edges are placed in the binder against the hot-melt adhesive. The binder is then closed and placed in proximity to a source of microwave radiation, typically within a microwave oven such as microwave oven 45 shown in FIG. 6. Preferably, the binder is positioned inside the microwave oven so that the outer edges of the front and back covers are elevated relative to the spine. Angling the binder in this manner exploits gravity for the purpose of keeping the sheets of papers in contact with the hot-melt adhesive when it melts, thereby increasing the probability that an edge of all of the sheets of paper will become embedded in the softened hot melt adhesive. Best results are achieved when the binder is disposed at an angle between about 30–90 degrees. (It should be noted, however, that because of the size of the inner cavities of most microwave ovens, the binder typically will not fit in the oven if positioned at an angle of about 90 degrees.) In addition to preferably being angled in the manner described above, the binder is preferably positioned in the microwave oven so that the spine is elevated a short distance, e.g. approximately one-quarter of an inch to about 1 inch, off the inner bottom surface of the microwave oven in order to ensure that the spine is uniformly exposed to the microwave radiation.

The binder and the papers disposed therein are then exposed to microwave radiation until the adhesive melts and the edges of the papers sink into the adhesive, i.e., typically within about 1–1.5 minutes, and preferably within about 30–60 seconds, of exposure to 600–700 watts of radiation. (The exact period of time required to cause the adhesive to melt will vary depending on the types of susceptors and adhesives used, as well as the microwave oven employed.) After irradiation, adhesive 43 is permitted to cool 15–30 seconds. If the binding is incomplete in some respect (e.g., only some of the sheets of papers are bound together), the loose sheets are placed in contact with the adhesive and irradiation is repeated.

A side view of a bound document 50 made using binder 11 is shown in FIG. 7, the papers inside binder 11 being represented by the letter P.

Figure 8:
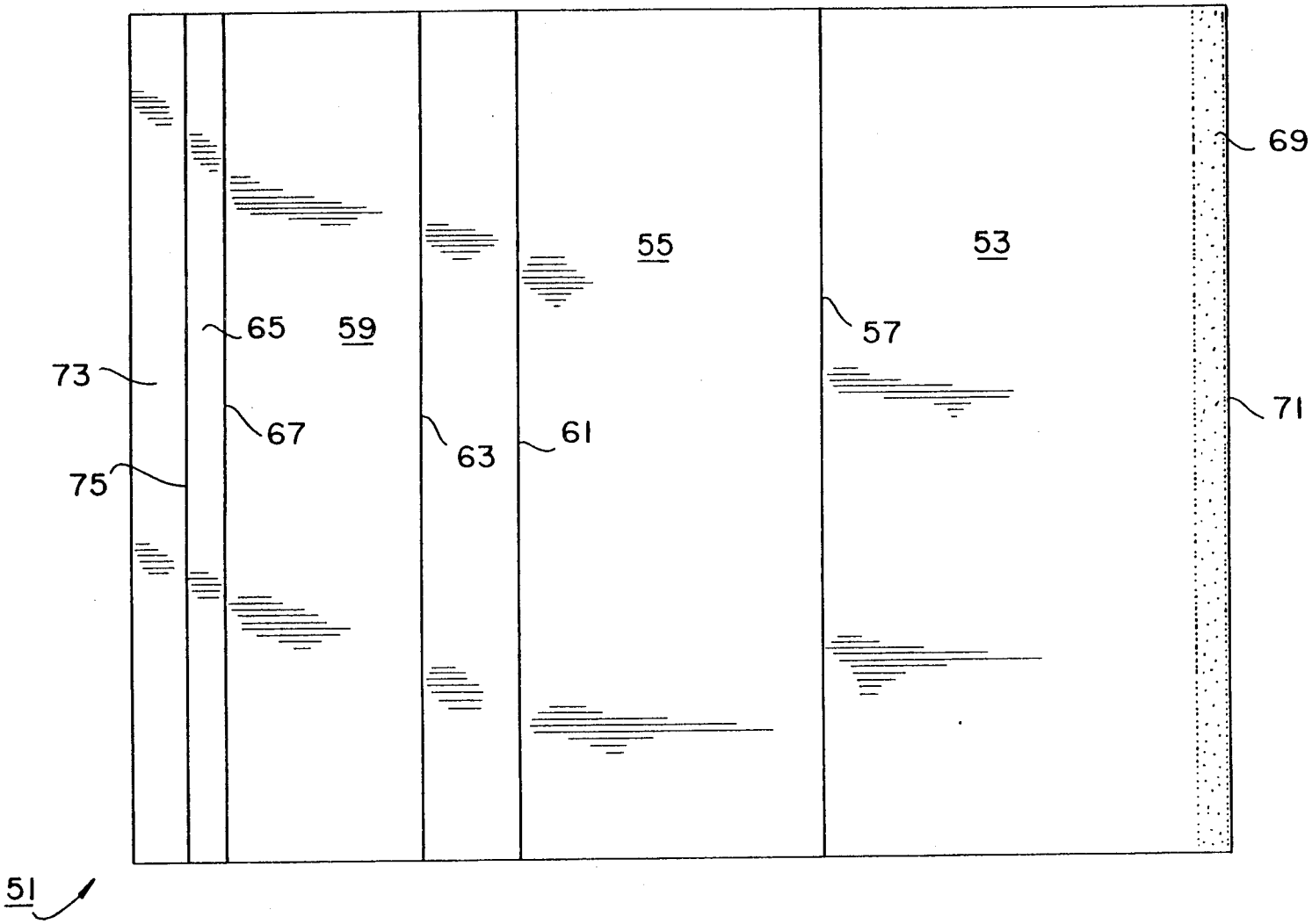
FIG. 8 is a front plan view of a blank from which may be constructed a stand for positioning a binder of the present invention in a microwave oven.

Referring now to FIG. 8, there is shown a blank from which a stand may be constructed for positioning a binder in a microwave oven in the manner described above, the blank being constructed according to the teachings of the present invention and represented generally by reference numeral 51.

Blank 51 is a unitary blank made from a sheet of microwave transparent material such as cardboard, paperboard, plastics having low or no polarity, or other similar material, which is of suitable thickness and is cut and scored as will hereinafter be described.

As can be seen, blank 51 is generally rectangular in shape and includes four-sided front and back panels 53 and 55, respectively, which are hingedly interconnected by a rigid fold line 57. Blank 51 further includes a four-sided bottom panel 59, which is hingedly connected to panel 55 by a rigid fold line 61. Bottom panel 59 includes a collapsible (reverse) fold line 63, which is spaced a short distance from and which is parallel to fold line 61. Fold line 63 permits blank 51 to be flattened for packaging and/or for storage purposes after its assembly.

Blank 51 further includes a four-sided panel 65, which is hingedly connected to panel 59 through a rigid fold line 67. As will be discussed below, the back surface of panel 65 is affixed to the front surface of panel 53 with an adhesive 69, which is applied to a small area of front panel 53 extending inwardly from outer edge 71.

Finally, blank 51 includes a four-sided panel 73, which is hingedly connected to panel 65 through a rigid reverse fold line 75. As will be seen below, when blank 51 is assembled as a stand, panel 73 acts as a shelf upon which the spine of a binder may be mounted.

Figure 9:
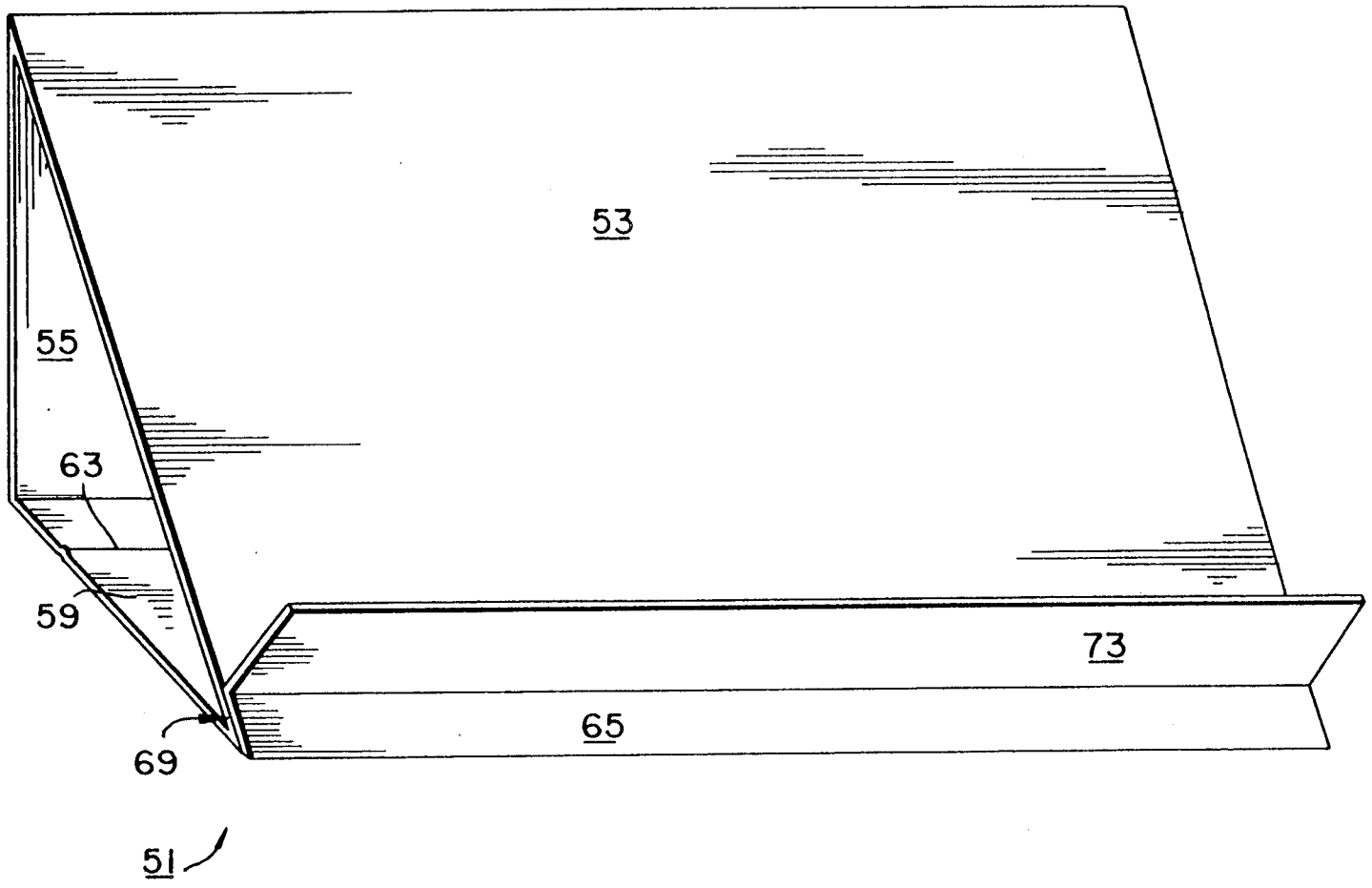
FIG. 9 is a front perspective view of a fabricated stand made from the blank shown in FIG. 8.

To assemble the stand shown in FIG. 9, panel 65 is brought under and around edge 71 so that its back surface is brought into contact with adhesive 69. Bottom panel 59 is then straightened out by applying pressure downwardly on collapsible (reverse) fold line 63.

Once assembled, the stand is used, for example, with binder 41 by placing spine 17 against panel 73 and permitting the remainder of the binder (and the papers P disposed therein) to rest against panel 53.

Figure 10:
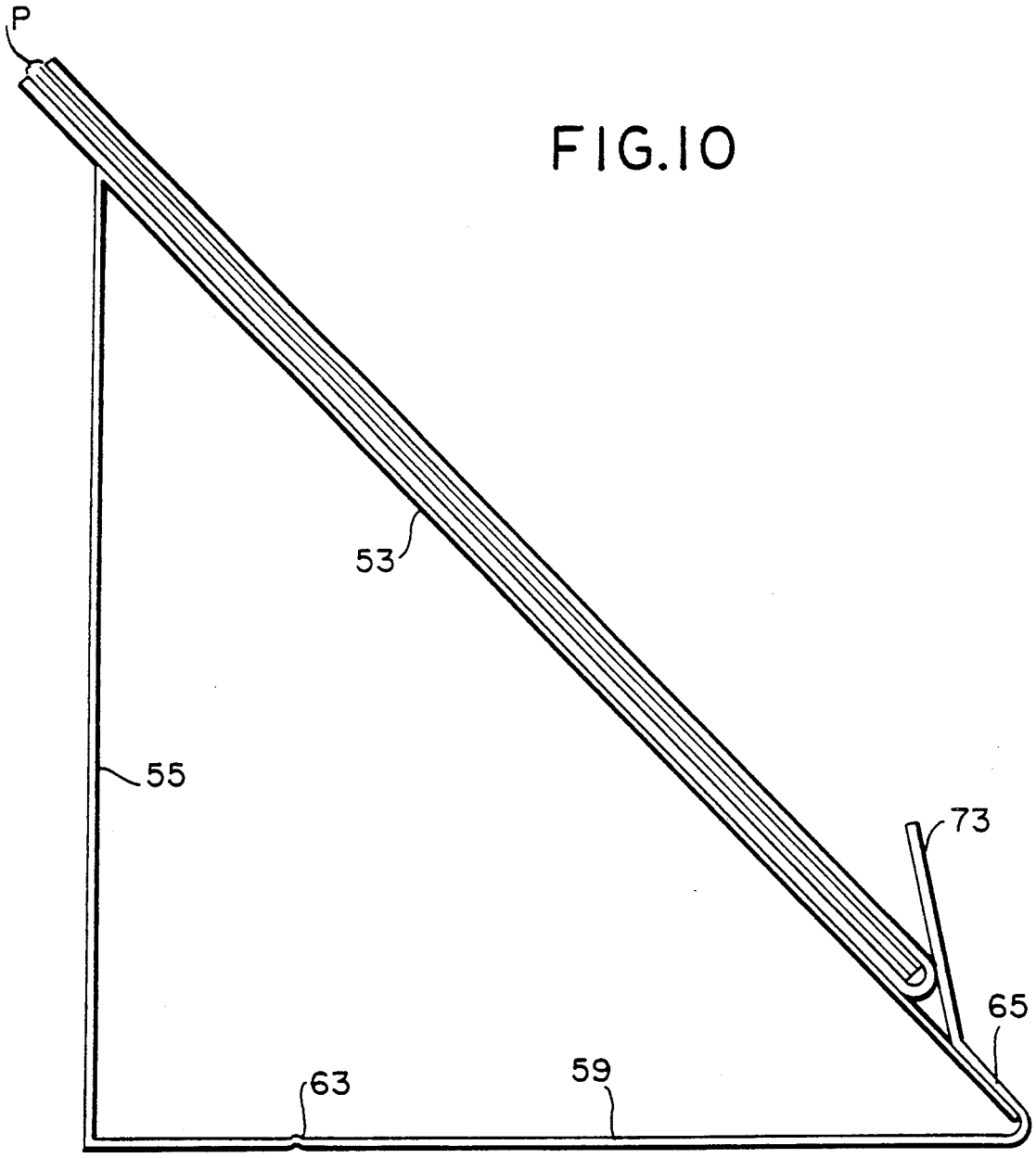
FIG. 10 is a side view of the stand shown in FIG. 9 with a binder mounted thereon, the binder having a plurality of sheets of paper disposed thereinside against the hot-melt adhesive ready to be bound together.

As can be seen in FIG. 10, the stand serves both to keep the binder at an angle (which is typically between about 30–45 degrees depending on the dimensions of blank 51) and to elevate the spine above the bottom surface of the microwave oven.

Figure 11:
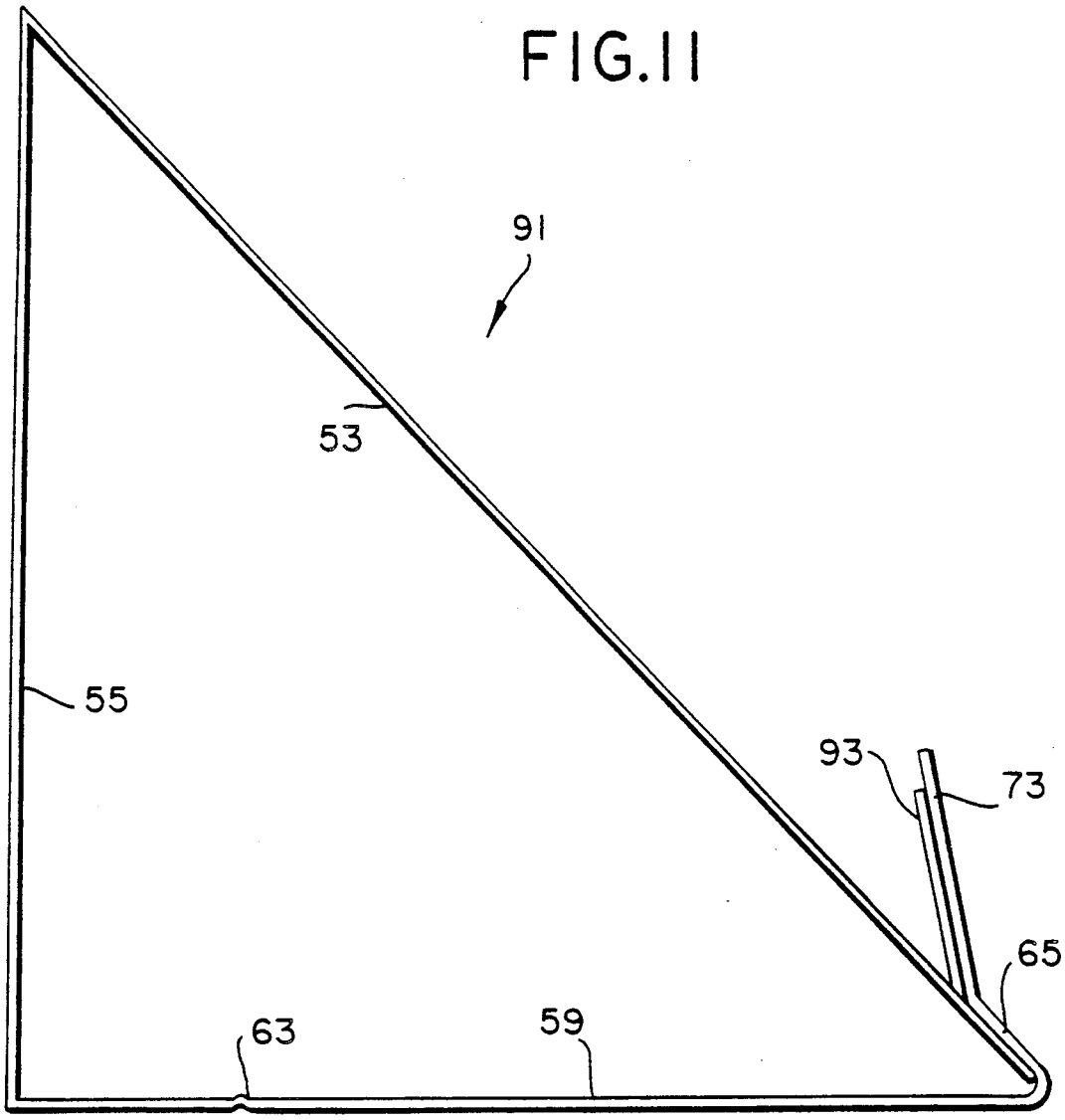
FIG. 11 is a side perspective view of another embodiment of a stand for positioning a binder in a microwave oven, the stand being constructed according to the teachings of the present invention.

Referring now to FIG. 11, there is shown another embodiment of a stand for positioning a microwave-activatable binder in a microwave oven, the stand being constructed according to the teachings of the present invention and represented generally by reference numeral 91.

Stand 91 is identical in construction to the stand shown in FIG. 9, except that stand 91 further includes a strip of microwave susceptor material 93 which is adhered, metallized side down, to panel 73. Susceptor material 93 may be any one or a combination of one or more of the susceptor materials discussed above in connection with susceptor 23. Preferably, susceptor 93 is a polyester film metallized with a vacuum deposit of aluminum to an optical density of about 0.18–0.29.

Stand 91 is intended for use with hot-melt adhesive binders which do not include a microwave susceptor.

In an embodiment of the invention that was actually built and tested, a hot-melt adhesive binder comprising an ethylene vinyl acetate adhesive having a high ethylene concentration was mounted in stand 91, susceptor 93 being a polyester film metallized with a vacuum deposit of aluminum to an optical density of about 0.18–0.29. Sufficient melting of the adhesive was found to occur after about 60 seconds of exposure to 600–700 watts of microwave radiation.

The embodiments of the present invention are intended to be merely exemplary and those skilled in the art shall be able to make numerous variations and modifications without departing from the spirit of the present invention. All such variations and modifications are intended to be within the scope of the present invention as defined in the appended claims.

We claim:

1. A method for making a bound document having at least one sheet of paper, the method comprising:

(a) providing a binder comprising a spine; a hot-melt adhesive disposed on the inside of said spine; and a microwave susceptor which generates heat when exposed to microwave energy and causes said hot melt adhesive to melt;

(b) disposing an edge of said at least one sheet of paper against said hot-melt adhesive;

(c) exposing said binder to microwave radiation so as to cause said hot-melt adhesive to melt and the edge of said at least one sheet of paper to become embedded in the melted adhesive; then (d) allowing said hot-melt adhesive to cool.

2. The method as defined in claim 1 wherein the microwave susceptor is a member mounted on the inside of the binder spine and the hot melt adhesive is mounted on the microwave susceptor.

3. The method as defined in claim 1 wherein the hot melt adhesive is mounted on the inside of the binder spine and the microwave susceptor is incorporated in the adhesive in the form of microwave absorbing materials in the group consisting of adhesive polymers and additives.

4. The method as defined in claim 1 further comprising during said exposing step the step of angling said binder downwardly in the direction toward said spine.

5. The method as defined in claim 4 wherein said binder is angled downwardly between about 30 degrees and 90 degrees.

6. The method as claimed in claim 1 wherein said hot-melt adhesive is selected from the group consisting of ethylene vinyl acetate copolymer based adhesives and ethylene methyl acrylate copolymer based adhesives.

7. The method as claimed in claim 1 wherein said hot-melt adhesive is selected from the group consisting of ethylene methyl acrylate copolymer based adhesives having a hydrogenated terpene tackifier resin.

8. The method as claimed in claim 1 further comprising the step of repeating steps (b) through (d) to bind any sheet of paper not embedded in said hot-melt adhesive or to remove or add sheets.

9. A method for making a bound document having at least one sheet of paper comprising:

(a) providing a binder comprising a spine and a hot-melt adhesive mounted on the inside of said spine;

(b) disposing an edge of said at least one sheet of paper against said hot-melt adhesive;

(c) disposing a microwave susceptor on the outside of said spine;

(d) exposing said binder and said microwave susceptor to microwave energy for a sufficient period of time to cause said hot-melt adhesive to melt and the edge of said at least one sheet of paper to become embedded in the melted adhesive, without significantly damaging said at least one sheet of paper; then (e) allowing said hot-melt adhesive to cool.

10. The method as claimed in claim 9 further comprising during said exposing step the step of angling said binder downwardly in the direction towards said spine.

11. The method as claimed in claim 10 wherein said binder is angled downwardly between about 30 degrees and 90 degrees.

12. The method as claimed in claim 9 wherein said microwave radiation is provided by a microwave oven, the method further comprising during said exposing step the step of elevating said spine and said microwave susceptor relative to the bottom surface of said microwave oven.

13. The method as defined in claim 9, wherein the disposing step (c) comprises mounting said binder in a stand, said stand containing the microwave susceptor.

14. A binder for use in making a bound document having at least one sheet of paper comprising:

(a) a spine;

(b) a microwave susceptor on said spine; and (c) a hot-melt adhesive on said microwave susceptor.

15. The binder as claimed in claim 14 wherein said microwave susceptor is selected from the group consisting of high temperature films having a thin layer of aluminum with an optical density between about 0.18–0.29, high temperature films having a thin layer of sputter coated stainless steel, high temperature films having a thin layer of brass and/or copper, and high temperature films having a thin layer of carbon black loaded material.

16. The binder as claimed in claim 15 wherein said microwave susceptor is selected from the group of microwave susceptors consisting of polyester films having a thin layer of vacuum deposited aluminum with an optical density between about 0.18–0.29.

17. The binder as claimed in claim 14 wherein said hot-melt adhesive is based on a material selected from the group consisting of ethylene methyl acrylates, ethylene vinyl acetates, polyamides, polyesters, olefins, styrenes, acrylics, and ethylene acrylates.

18. The binder as claimed in claim 17 wherein said hot-melt adhesive is an ethylene methyl acrylate having a hydrogenated terpene tackifier resin.

19. The binder as claimed in claim 14 further comprising front and back covers secured to said spine.

20. A binder for use in making a bound document having at least one sheet of paper comprising:

(a) a spine; and (b) a hot-melt adhesive on said spine, said hot-melt adhesive having a microwave susceptor material incorporated thereinto.

21. The binder as claimed in claim 20 wherein said hot-melt adhesive is based on a material selected from the group consisting of ethylene methyl acrylates, olefins, ethylene vinyl acetates, polyamides, polyesters, acrylics, styrenes, and ethylene acrylates.

22. The binder as claimed in claim 21 wherein said hot-melt adhesive is based upon an ethylene methyl acrylate having a hydrogenated terpene tackifier resin.

23. The binder as claimed in claim 20 wherein said microwave susceptor material is selected from the group consisting of carbon fibers, carbon black, graphite, antistatic agents, metal particles, and mixtures of two or more of the above.

24. The binder as claimed in claim 20 further comprising front and back covers secured to said spine.

* * * * *